US006273005B1

(12) United States Patent
Wehrmeyer

(10) Patent No.: US 6,273,005 B1
(45) Date of Patent: Aug. 14, 2001

(54) PUBLIC RESTROOM SHELF

(76) Inventor: Matthew B. Wehrmeyer, 232 Applewood Dr., Lakeside Park, KY (US) 41017

( * ) Notice: Subject to any disclaimer, the term of this patent is extended or adjusted under 35 U.S.C. 154(b) by 0 days.

(21) Appl. No.: 09/714,305

(22) Filed: Nov. 16, 2000

(51) Int. Cl.[7] ..... A47B 37/00
(52) U.S. Cl. ..... 108/42; 211/119.001; 248/219.2
(58) Field of Search ..... 108/42, 50.01; 211/119.009; 248/219.2; 4/301

(56) References Cited

U.S. PATENT DOCUMENTS

D. 248,702 8/1978 Baldini .
D. 267,059 11/1982 Thompson .
D. 274,023 5/1984 Boroch .
D. 329,158 9/1992 Tuzi .
D. 339,260 9/1993 Hillard et al. .
D. 358,733 5/1995 Paul .
D. 381,539 7/1997 Lee .
2,979,211 * 4/1961 Fritzel ..... 211/119.009
3,342,343 * 9/1967 Youlden ..... 211/119.009
4,870,907 10/1989 McKee .
5,540,159 * 7/1996 Anderson ..... 108/50.01
5,623,880 4/1997 Kuntz .
5,638,966 6/1997 Kuntz .
5,664,748 * 9/1997 Speece et al. ..... 248/219.2
5,996,506 * 12/1999 Woytovich ..... 108/42

* cited by examiner

*Primary Examiner*—Peter M. Cuomo
*Assistant Examiner*—Jerry Anderson
(74) *Attorney, Agent, or Firm*—John D. Gugliotta

(57) ABSTRACT

The present invention is a rectangular shelf having a top side and a bottom side which includes a hexagonal-shaped valve receiving cap for being installed to a conventional urinal or toilet in a public restroom.

6 Claims, 3 Drawing Sheets

PUBLIC RESTROOM SHELF

RELATED APPLICATIONS

The present invention was first described in Disclosure Document No. 472,518 filed on Apr. 13, 2000. There are no previously filed, nor currently any co-pending applications, anywhere in the world.

BACKGROUND OF THE INVENTION

1. Field of the Invention

The present invention relates generally to shelving for bathrooms and, more particularly, to a public restroom shelf.

2. Description of the Related Art

While public restrooms provide their users with services and supplies to take care of their personal needs, they do little else. Perhaps the biggest complaint of users' of public restrooms is the lack of horizontal surfaces onto which they can place small personal objects. This problem is most prevalent in restrooms that are part of large public gatherings such as sporting events, entertainment shows and the like. At these gatherings, people are forced to hold items such as beverage cups, food and the like in their hands, balance them on top of fixtures, or set them on the floor. Not only are these solutions messy, they are unsanitary as well. This problem also arises in restrooms in office buildings, schools and the like where one needs to set a cellular phone, notebook, pad of paper, book or similar item and there is no space. In these conditions, the person is forced to hold such items under their chin or arms while using the bathroom.

Accordingly, there exists a need for a means by which a storage location for small, personal items can be provided in public restrooms. The development of the public restroom shelf fulfills this need.

A search of the prior art did not disclose any patents that read directly on the claims of the instant invention; however, the following references were considered related. The following patents disclose the design and function of a bathroom shelf: U.S. Pat. No. 5,623,880 issued in the name of Kuntz; U.S. Pat. No. D 358,733 issued in the name of Paul; U.S. Pat. No. D 339,260 issued in the name of Hillard et al.; U.S. Pat. No. D 274,023 issued in the name of Boroch; U.S. Pat. No. D 267,059 issued in the name of Thompson; and U.S. Pat. No. D 248,702 issued in the name of Baldini;

U.S. Pat. No. 5,638,966 issued in the name of Kuntz describes freestanding, sheet metal bathroom shelves.

U.S. Pat. No. 4,870,907 issued in the name of McKee discloses a towel rack convenience shelf.

U.S. Pat. No. D 381,539 issued in the name of Lee describes the ornamental design for a decorative bathroom corner shelf and bathroom tissue concealer.

U.S. Pat. No. D 329,158 issued in the name of Tuzi discloses the ornamental design for a bathroom corner shelf unit.

Consequently, a need has been felt for providing a device which allows for greater ease of use and increased comfort while using a pubic restroom in a manner which is quick, easy and efficient.

SUMMARY OF THE INVENTION

Therefore, it is an object of the present invention to provide a public restroom shelf which provides a location to set small personal objects and alleviates the need to hold objects under a chin or arms.

It is another object of the present invention to provide a device which can be used over urinals or in toilet stalls.

It is still another object of the present invention to provide a device which can hold drinks, keys, cell phones, notebooks, papers and other hand-held items.

It is still another object of the present invention to provide a device which can be utilized in various environments such as sport arenas, office buildings, restaurants and schools.

It is another object of the present invention to provide a device being more sanitary which prevents less chance of spreading and contracting germs and diseases.

It is another object of the present invention to provide a device which can be used in residential bathrooms as well.

Briefly described according to one embodiment of the present invention, a public restroom shelf is disclosed so as to provide a means by which a storage location for small, personal items can be provided in public restrooms.

The public restroom shelf is a small shelf, approximately 6 inches by 4 inches, for use over a urinal or in a toilet stall in a public restroom. It is intended for the placement of personal items such as beverages, cellular phones, keys, and similar hand-held items. As such, a larger version may be applicable for institutional use, such as schools and public buildings. The invention is made of either plastic or metal in a manner suitable for the environment found in a public restroom. The invention would attach directly to the piping as provided as part of the urinal water piping. It is envisioned that the invention may be attached to the wall or stall divider using common, well-known attachment means such as wall anchors or sheet metal screws. Such designs allow the invention to be easily replaced if it is damaged or vandalized.

The use of the public restroom shelf provides a device which allows for greater ease of use and increased comfort while using a pubic restroom in a manner which is quick, easy and efficient.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTION OF THE PREFERRED EMBODIMENT

1. Detailed Description of the Figures

Figure 1:
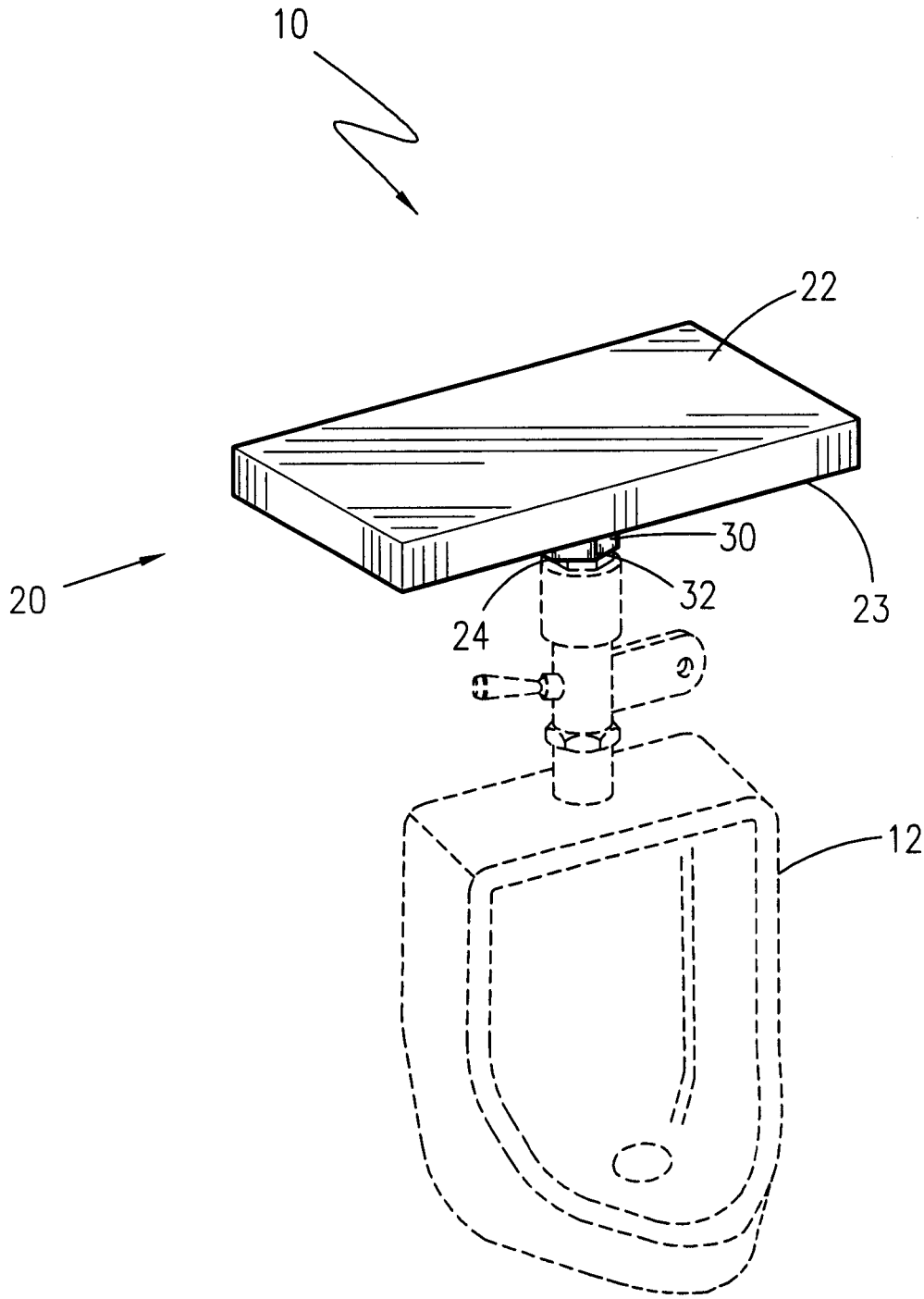
FIG. 1 is a perspective view of a public restroom shelf according to the preferred embodiment of the present invention.

Referring now to FIGS. 1–5, a public restroom shelf 10 is shown, according to the present invention, comprised of a rectangular shelf 20 having a top side 22 and a bottom side 23 which includes a hexagonal-shaped valve receiving cap 24 for being installed to a conventional urinal or toilet 12 in a public restroom, so as to provide a storage location for small personal items.

For purposes of this disclosure, the present invention is to be utilized with a conventional urinal or toilet 12 comprising a 1¾ inch hexagonal-shaped valve screw 14 being in full view and affixed to a top portion of the plumbing thereof.

The rectangular shelf 20 is constructed from a material such as stainless steel, aluminum or high-strength plastic in a manner suitable for the environment found in a public restroom.

It is envisioned that the rectangular shelf 20 measures approximately 6 inches in length by 4 inches in width and has a height of approximately 1 inch.

Figure 2:
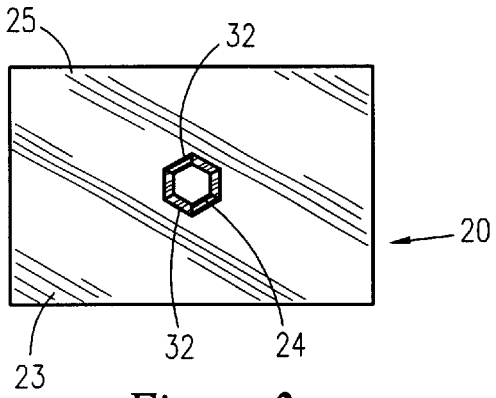
FIG. 2 is a bottom plan view thereof.
Figure 3:
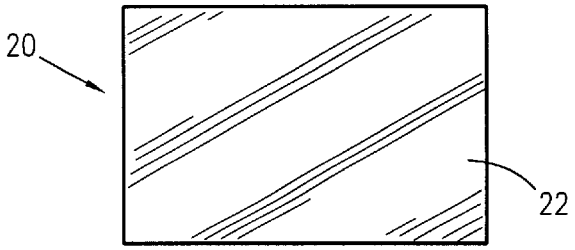
FIG. 3 is a top plan view thereof.
Figure 4:
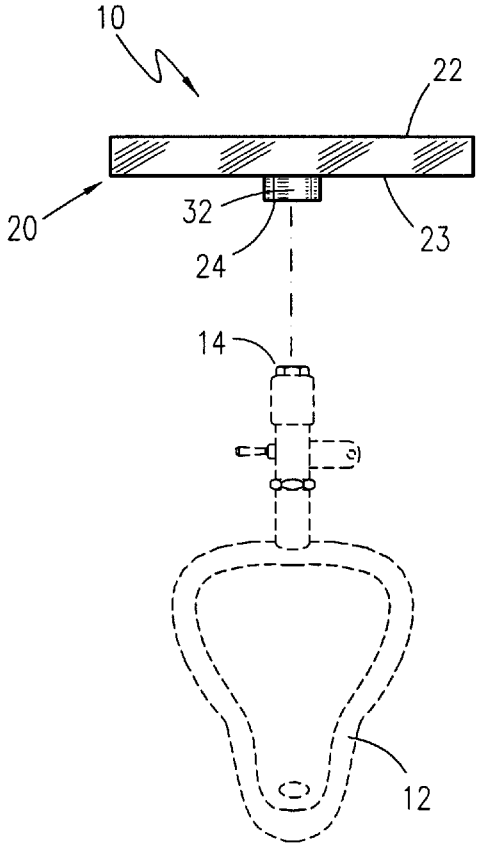
FIG. 4 is an exploded perspective view of the public restroom shelf according to the preferred embodiment of the present invention.
Figure 5:
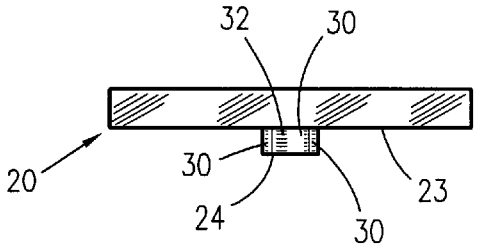
FIG. 5 is a front end elevational view of the present invention according to the preferred embodiment.

Referring now in greater detail to FIGS. 2, 4, and 5, in order to securely attach the rectangular shelf 20 to a conventional urinal 12, a hexagonal-shaped, hollow valve-receiving cap 24 mounted perpendicularly along a linearly elongated centerline to the bottom side 23 of the rectangular shelf 20 is disclosed. The valve-receiving cap 24 is designed so as to provide a snug fit when slidably received by the valve screw 14 of a conventional urinal 12 such that the valve-receiving cap 24 is held in place through frictional impingement.

In order to permanently attach the valve-receiving cap 24 to the valve screw 14, a plurality of small screws 30 are inserted through a plurality of apertures 32 aligned equidistant to one another along outer sidewalls 26 of the valve-receiving cap 24. Once the valve-receiving cap 24 has been slidably received by the valve screw 14, the screws 30 are tightened, thereby permanently attaching the valve-receiving cap 24 to the valve screw 14. Such means for attachment allows for the public restroom shelf 10 to be easily replaced if damaged or vandalized.

Figure 6A:
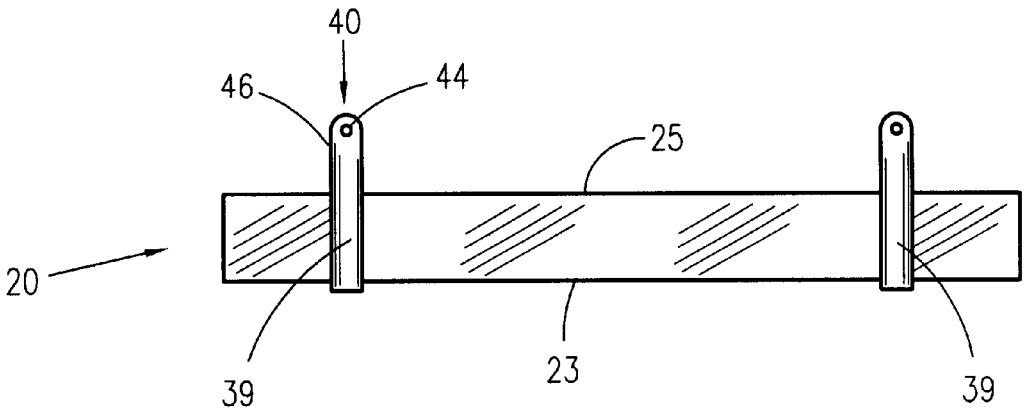
FIG. 6*a* is a rear end elevational view of an alternate preferred embodiment of the present invention.
Figure 6B:
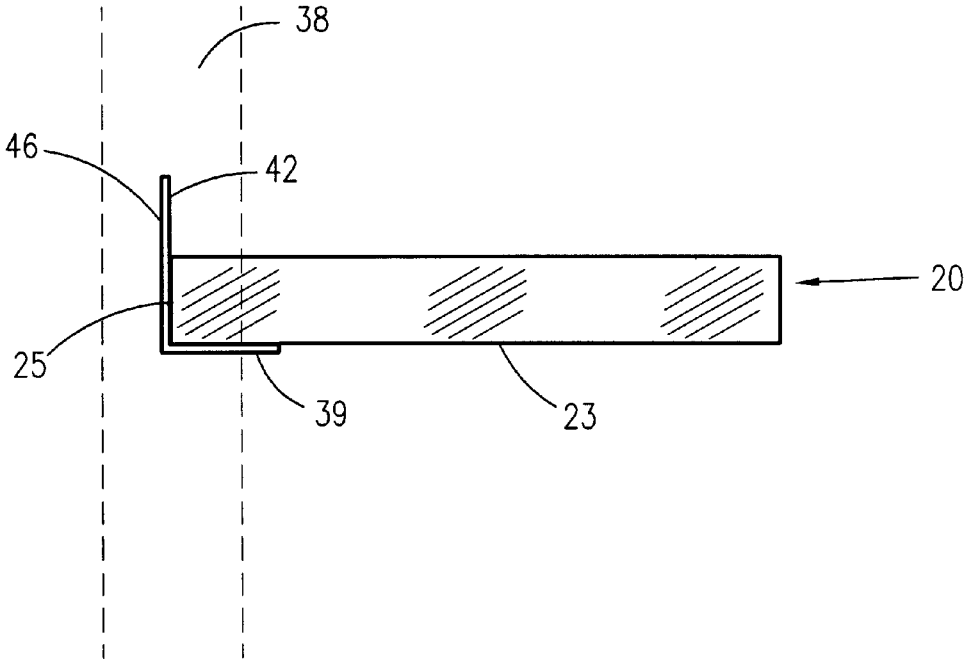
FIG. 6*b* is a side elevational view of an alternate preferred embodiment of the present invention.

Referring now to FIGS. 6*a* and 6*b*, an alternate preferred embodiment of the present invention is disclosed. The alternated preferred embodiment includes a rectangular shelf 20 which is identical to the preferred embodiment of the present invention, with the exception that the valve-receiving cap 24 is excluded, and a pair of L-shaped brackets 39 are utilized.

The L-shaped brackets, being constructed of stainless steel, are welded to a rear lateral sidewall 25 and bottom side 23 at ends of the rectangular shelf 20.

The alternate preferred embodiment is permanently attached to a wall or stall divider 38 by a wall attachment means 40, such as sheet metal screws 42 inserted through holes 44 formed at a top portion 46 of each L-shaped bracket 39. Once the alternate preferred embodiment is placed in a desired location on the stall divider 38, sheet metal screws 42 are inserted through holes 44 formed in each L-shaped bracket 39 and tightened, thereby permanently attaching the alternate preferred embodiment to the stall divider 38.

2. Operation of the Preferred Embodiment

To use the present invention, after the valve-receiving cap 24 of the rectangular shelf 20 has been slidably received by the valve screw 14 of a conventional urinal 12, small screws 30 are inserted through apertures 32 aligned along the outer sidewalls 26 of the valve-receiving cap 24 and are tightened, thereby permanently attaching the valve-receiving cap 24 to the valve screw 14 of the conventional urinal 12. The user then places personal items on the public restroom shelf 10 for temporary storage.

The use of the present invention provides a device which allows for greater ease of use and increased comfort while using a pubic restroom in a manner which is quick, easy and efficient.

Therefore, the foregoing description is included to illustrate the operation of the preferred embodiment and is not meant to limit the scope of the invention. As one can envision, an individual skilled in the relevant art, in conjunction with the present teachings, would be capable of incorporating many minor modifications that are anticipated within this disclosure. Therefore, the scope of the invention is to be broadly limited only by the following claims.

What is claimed is:

1. A public restroom shelf comprising:

a rectangular shelf having a top side and a bottom side which includes a hexagonal-shaped valve receiving cap for being installed to a conventional urinal or toilet in a public restroom.

2. The public restroom shelf of claim 1, wherein said valve receiving cap is adapted to receive a 1¾ inch hexagonal-shaped valve screw.

3. The public restroom shelf of claim 1, wherein said rectangular shelf is constructed from a material selected from the group comprising stainless steel, aluminum, and plastic.

4. The public restroom shelf of claim 1, wherein said rectangular shelf measures approximately 6 inches in length by 4 inches in width and has a height of approximately 1 inch.

5. A public restroom shelf comprising:

a rectangular shelf; and a hexagonal-shaped, hollow valve-receiving cap mounted perpendicularly along a linearly elongated centerline to the bottom side of said rectangular shelf; and wherein said valve-receiving cap is designed so as to provide a snug fit when slidably received by the valve screw of a conventional urinal such that the valve-receiving cap is held in place through frictional impingement.

6. The public restroom shelf of claim 5, further comprising:

a plurality of screws inserted through a plurality of apertures aligned equidistant to one another along an outer sidewall of the valve-receiving cap, such that once said valve-receiving cap has been slidably received by said valve screw and said screws are tightened, said shelf is permanently attached to said valve-receiving cap.

* * * * *